US006834733B1

(12) United States Patent
Maouche et al.

(10) Patent No.: US 6,834,733 B1
(45) Date of Patent: Dec. 28, 2004

(54) SPIRAL WAVE BLADED DRAG BIT

(75) Inventors: Zakaria Maouche, Pau (FR); Alfazazi Dourfaye, Paris (FR); Gilles J-P Gallego, Ibos (FR)

(73) Assignee: Varel International, Ltd., Carrollton, TX (US)

( * ) Notice: Subject to any disclaimer, the term of this patent is extended or adjusted under 35 U.S.C. 154(b) by 34 days.

(21) Appl. No.: 10/235,690

(22) Filed: Sep. 4, 2002

(51) Int. Cl.[7] ..... E21B 10/60

(52) U.S. Cl. ..... 175/378; 175/400; 175/429; 175/431

(58) Field of Search ..... 175/378, 400, 175/429, 431

(56) References Cited

U.S. PATENT DOCUMENTS

| | | | | | |
|---|---|---|---|---|---|
| 4,350,215 | A | * | 9/1982 | Radtke | 175/433 |
| 4,794,994 | A | | 1/1989 | Deane et al. | 175/329 |
| 4,848,489 | A | * | 7/1989 | Deane | 175/429 |
| 4,848,491 | A | | 7/1989 | Burridge et al. | 175/329 |
| 4,883,132 | A | | 11/1989 | Tibbitts | 175/65 |
| 4,887,677 | A | | 12/1989 | Warren et al. | 175/339 |
| 5,443,565 | A | | 8/1995 | Strange, Jr. | 175/431 |
| 5,447,208 | A | | 9/1995 | Lund et al. | 175/428 |
| 5,699,868 | A | * | 12/1997 | Caraway et al. | 175/339 |
| 5,967,247 | A | | 10/1999 | Pessier | 175/408 |
| 6,021,858 | A | * | 2/2000 | Southland | 175/431 |
| 6,062,325 | A | * | 5/2000 | Taylor et al. | 175/393 |
| 6,123,160 | A | * | 9/2000 | Tibbitts | 175/385 |
| 6,125,947 | A | | 10/2000 | Trujillo et al. | 175/57 |
| 6,302,223 | B1 | | 10/2001 | Sinor | 175/393 |
| 6,321,862 | B1 | * | 11/2001 | Beuershausen et al. | 175/406 |

* cited by examiner

*Primary Examiner*—David Bagnell
*Assistant Examiner*—Shane Bomar
(74) *Attorney, Agent, or Firm*—Baker Botts L.L.P.

(57) ABSTRACT

A drag-type drill bit for bore hole drilling in earth formation comprises a bit body having a threaded pin on one end for coupling to a drill string. A substantially dome-shaped cutter head is formed integral with the bit body opposite from the threaded pin. Formed integral with and extending from the cutter head is a plurality of circumferentially spaced fixed and/or variable pitch spiral blades having a succession of curved segments. The variable pitch pattern curves from substantially the center of and around the cutter head to the gage area. A plurality of generally cylindrical cutting elements, such as PDC elements, are fixed to each of the spiral blades and a plurality of nozzles are positioned around the cutter head to direct drilling fluid passing through the bit body against the blades to the annulus surrounding the bit body and the bore hole.

45 Claims, 8 Drawing Sheets

SPIRAL WAVE BLADED DRAG BIT

TECHNICAL FIELD OF THE INVENTION

This invention relates to a drag-type drill bit for downhole drilling of a bore hole, and more particularly to a drag-type drill bit having variable pitch generally spiral shaped blades extending from the bit face to the gage area.

BACKGROUND OF THE INVENTION

Fixed cutter rotary drag-type bits for earth boring were developed several decades past and have been in use for bore-hole drilling in various subterranean formations. During the development of the drag-type drill bit, the primary objective focus was high penetration rates, long drill bit useful life, and dynamic stability ("bit whirl" correction). Various efforts were made to address the dynamic stability issue including elongated gage surfaces and a 360 degree full contact gage, both intended to restrict lateral vibrations thereby reducing bit whirl and enabling bit steerability, that is, directional drilling. Improvement of dynamic stability of a drag-type drill bit resulted in less bore hole enlargement and in smooth trajectories for directional drilling, all obtained with less load loss, more predictable weight transfer and improved well completion.

Along with the development of improved dynamic stability it has also become common practice to employ cutting elements made of man-made polycrystalline diamond compacts or cutters projecting from the bit body of a drag-type drill bit. One polycrystalline diamond cutting structure in common use has been commonly referred to as polycrystalline diamond compact (PDC) comprising a small carbide cylindrical body with a thin layer of polycrystalline diamond bonded to one face thereof. This is a conventional PDC-type diamond drill bit cutting element capable of drilling in softer formations.

Although development of the PDC cutting element has resulted in more extensive use of drag-type drill bits there has been an undesirable increase in problems associated with heat degradation resulting from "balling". Balling is defined as a buildup of formation chips or cuttings on the bit face and gage area or the bore hole bottom and is most often a problem with sticky formations, such as sticky shales or similar formations having a large percentage of clays that adhere to the cutting face of the bit. This balling condition not only hampers drilling activity, but also causes rapid heat deterioration of the cutting elements due to poor circulation and decreased cutting efficiency.

A number of efforts have been made to correct the balling condition such as a deep-bladed design, however, this resulted in considerable wear and breakage when harder formations were encountered because of the relatively small number of cutting elements. Recent computational fluid dynamics flow analysis indicates that hydraulic efficiency is seriously compromised in drag-type drill bits with high spiral blades supporting the cutting elements. The spiral blade configuration induces a specific fluid flow trajectory systematically projected on the back of the adjacent spiral blade thereby compromising cutting structure cleaning and thus an accumulation of sticky formation cuttings thereby inducing "balling". Further, computational fluid dynamics has shown that because of the very high spiral angle, the fluid trajectory near the gage area is almost circumferential thereby inhibiting the desired flow of cuttings from around the bit past the supporting drill string to the surface of the bore hole. The conclusion reached from the recent computational fluid dynamics flow analysis is that the trajectories of the drilling mud from the nozzle orifices of the drill bit face result in low velocity zones and recent fluid tests correlate the results of the fluid dynamic flow analysis.

Another approach to address the balling problem was to utilize a high density of cutting elements and fluid nozzles directed to the well bore bottom. After the fluid impinges the well bore bottom a portion of the fluid flows at relatively low velocity through the flow channels between the plurality of blades. The fluid velocity in these channels is too low for providing adequate cleaning of the cutting elements when drilling in soft sticky formations to prevent balling. Other attempts to address the balling condition utilized a relatively large number of nozzles in an effort to adequately clean all the cutting elements on the bit. A reduction in velocity results when the total orifice area for the bit is increased beyond a reasonable limit and results in an increase of the probability of clogging of the nozzle orifices.

The development of a PDC drag bit with high spiral blades presents some design constraints related to the side rake angle parameter. The cutters have to be normal to the cutting trajectory, and have to be oriented in a side direction (cutter side rake angle). The combination of the spiral blade shape and the three-dimensional positioning of the cutters causes collisions to occur between some cutters. One solution for overcoming this problem used in the past was to reduce the number of cutters. This affects the cutting process efficiency.

SUMMARY OF THE INVENTION

The present invention comprises a drag-type drill bit having a bit body with a plurality of blades extending from the bit face to the gage area, the blades have a general spiral shape with a variable pitch from the bit face to the gage area. The spiral pitch either increases or decreases from the bit face to the gage area with a positive or negative orientation for blades of a drill bit rotating from right to left. Each of the plurality of blades comprises a plurality of segments having a definable spiral pitch value (positive or negative) depending on the direction of the bit rotation. Depending on the direction of the bit rotation, the plurality of segments define right spiral pitch or left spiral pitch for the plurality of blades.

Variable pitch spiral blades can be obtained by a succession of segments with different curvature radius as well as by spline curves defining essentially the same shape.

Further in accordance with the present invention there is provided a drag-type drill bit having a plurality of blades extending above the bit face to the gage area wherein the spiral pitch of each blade is constant along the length of the blade (general virtual shape) with the front and/or back faces of a blade having a variable spiral pitch (a wave-shaped face).

In accordance with the present invention there is provided a drag-type drill bit with variable pitch spiral blades having a succession of concave and/or convex segments (succession of concave segments with different pitch values, succession of convex segments with different pitch values, succession of convex-concave segments with different pitch values).

The drag-type drill bit of the present invention comprises a bit body having a threaded pin on one end for coupling to a drill string. A substantially dome-shaped cutter head is formed integral with the bit body opposite from the threaded pin. A plurality of circumferentially spaced wave-shaped blades are formed integral with and extending from the cutter head. The wave-shaped blades comprising a variable pitch pattern having a succession of curved segments, the variable pitch pattern curving from substantially the center of and around the cutter head to the gage area in the direction of rotation of the bit body. A plurality of generally cylindrical cutting elements are embedded in each of the wave-shaped blades and a plurality of nozzles are positioned around the cutter head to direct drilling fluid passing through the bit body against the wave-shaped blades to the annulus surrounding the bit body in the bore hole.

Further in accordance with the present invention there is provided a drag-type drill bit for bore hole drilling in earth formations comprising a bit body having a threaded pin end for coupling to a drill string. A substantially dome-shaped cutter head is formed integral with the bit body opposite from the threaded pin. A first plurality of circumferentially spaced wave-shaped blades are formed integral with and extend from the cutter head, the first plurality of wave-shaped blades comprising a variable pitch pattern having a succession of curved segments or spline curves, the variable pitch pattern curving from substantially the center of and around the cutter head to the gage area in the direction of rotation of the bit body or in a direction opposite to the rotation of the bit body. A second plurality of circumferentially spaced blades are formed integral with and extend from the cutter head between adjacent wave-shaped blades of the first plurality, blades of the second plurality comprising a fixed pitched pattern curving from a position displaced from the center of and around the cutter head to the gage area also in the direction of rotation of the bit body or in the opposite direction. A plurality of generally cylindrical cutting elements are embedded in each of the first plurality of wave-shaped blades and the second plurality of blades, and a plurality of nozzles are positioned around the cutter head to direct drilling fluid passing through the bit body against the first plurality of wave-shaped blades and the second plurality of blades to the annulus surrounding the bit body and the bore hole.

Technical advantages of the drill bit of the present invention includes hydraulic efficiency based on the variable pitch pattern of spiral blades extending above the bit face of the bit body to the gage area. An additional technical advantage is the utilization of the concavity of variable pitch spiral blades to function as a deflector for fluid flow from a nozzle thereby improving hydraulic flow efficiency. A further technical advantage of the present invention is a drag-type drill bit having variable pitch blades creating fluid channels near fluid nozzles and the gage area to clean cutting elements on the bit shoulder and evacuate efficiently the drilling fluid and rock chips towards the annulus between the drill string and the walls of the bore hole. An additional advantage includes cutting efficiency based on the use of cutters with side rake angles.

DETAILED DESCRIPTION OF THE INVENTION

Figure 1:
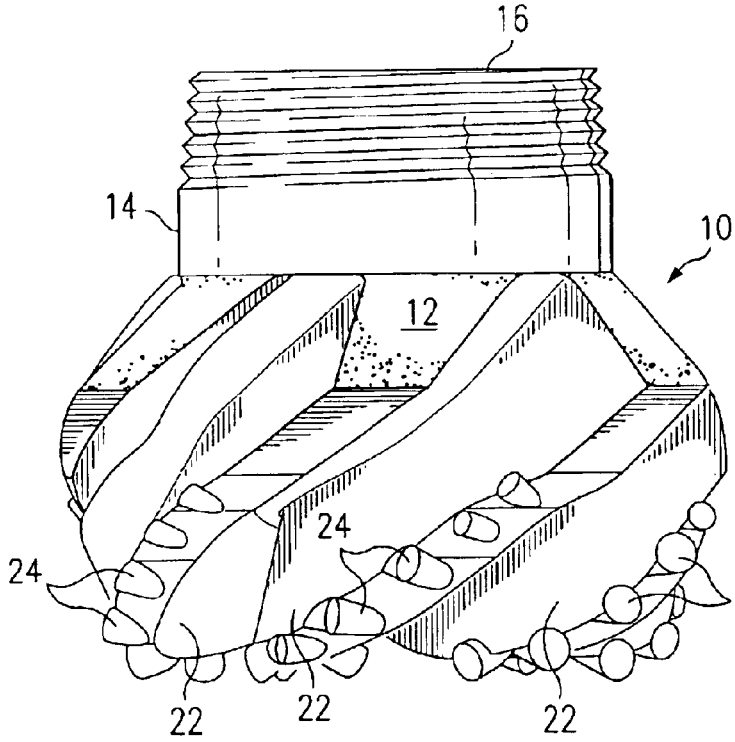
FIG. 1 is a perspective view of a drill bit having fixed pitch blades.
Figure 2:
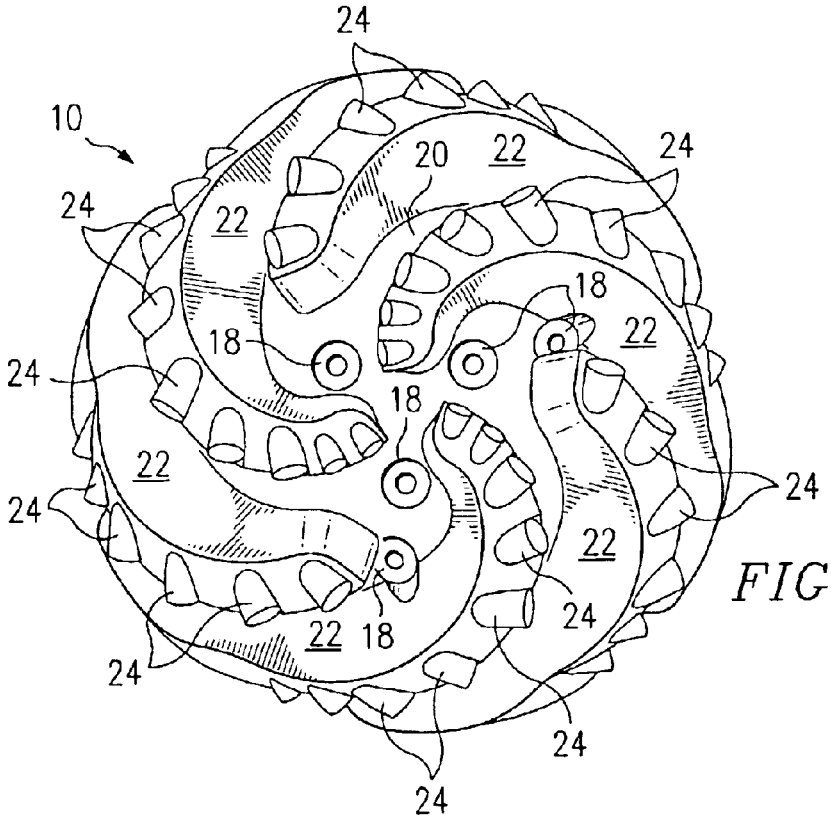
FIG. 2 is an end view of the operating end face of the drill bit of FIG. 1 further illustrating fixed pitch blades and nozzle orifice placement.

Referring to FIGS. 1 and 2, there is shown a drill bit 10 embodying fixed pitch blades. As illustrated, the drill bit 10 has fixed cutting elements and is conventionally referred to in the industry as a drag bit. The drill bit 10 comprises a bit body 12, a shank 14, and a threaded connection or pin 16 for connecting the drill bit to a sub as part of a drill string (not shown) in a manner conventional for drilling through earth formations. The bit body 12 is fabricated by one of several processes that creates either a cast steel bit body or a matrix bit body.

The bit body 12 includes a central longitudinal bore (not shown) as is conventional with drill bit construction as a passage for drilling fluid to flow through the drill string into the bit body and exit through nozzles 18 arranged in the operating end face 20. Extending from essentially the center of the operating end face 20 are circumferentially-spaced fixed pitch spiral blades 22 that extend down the side of the bit body 12 to the gage area. Attached to each of the fixed pitch spiral blades 22 is a pattern of cutting elements 24 for drilling in earth formations. Typically, the cutting elements 24 are polycrystalline diamond cutting (PDC) inserts or similar relatively hard material for boring into the rock of earth formations. Each of the cutting elements 24 is mounted in a pocket formed in the blades at a preferred back rake or side rake orientation.

A technical feature of the present invention is overcoming design constraints due to cutter collision by using side rake angles and to improve hydraulic efficiency over fixed pitch blades. The geometry of the fixed pitch blade induces potential collisions between the cutters when side rake angle and high spiral angle are utilized.

The geometry of the fixed pitch blade also produces a very specific flow trajectory. Simulations have shown that the fluid flow trajectory is systematically projected on the back face of the adjacent blade thereby compromising the cleaning of cutting elements and results in an accumulation of sticky formation cuttings that induce bit balling. In addition, as a result of very high spiral angles for fixed pitch blades, the fluid trajectory in the gage area is substantially circumferential. Such a circumferential trajectory results in the development of low velocity zones thereby creating a condition where the drilling fluid is pulled from the annulus between the drill bit and the bore hole towards the flow passages between adjacent fixed pitch spiral blades. In accordance with the present invention, variable pitch blades enable more efficient cutting process and hydraulics for bits using PDC cutters bonded to variable pitch spiral blades with large open faced volume.

Figure 3:
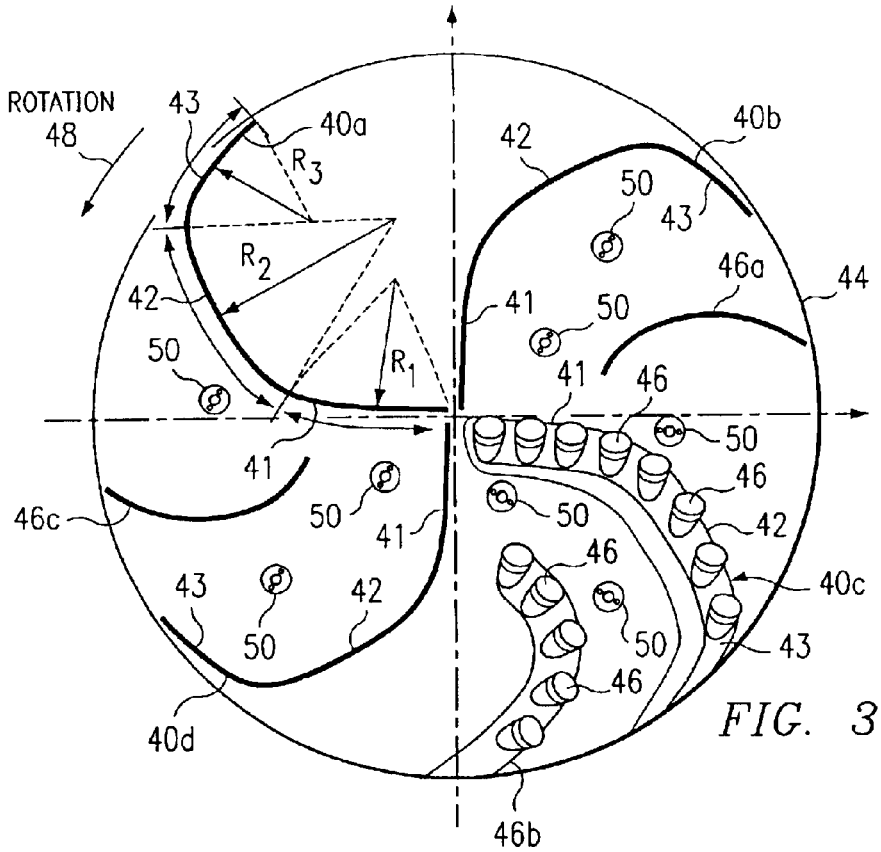
FIG. 3 is a schematic illustration of spiral-shaped blades with a variable pitch extending from the bit face to the gage area with a positive orientation for a drill bit rotating in a counterclockwise direction.

Referring to FIG. 3, there is schematically illustrated a dome-shaped cutter head having extending therefrom a first plurality of variable pitch spiral blades 40*a*, 40*b*, 40*c* and 40*d* each having three segments 41, 42 and 43 sequentially interconnected from the center of the dome-shaped cutter head to the gage area generally indicated by the reference number 44. Interspersed with the first plurality of variable pitched spiral blades 40*a*, 40*b*, 40*c* and 40*d* is a second plurality of fixed pitch blades 46*a*, 46*b* and 46*c*. Each of the first plurality of blades and each of the second plurality of blades support cutting elements 46 of conventional design and preferably PDC cutting elements. To avoid detailed complexity of FIG. 3, the cutting elements 46 are illustrated only for the variable pitch spiral blade 40*c* and the fixed pitch blade 46*b*.

In the embodiment of FIG. 3 the bit is designed to rotate in the counterclockwise direction (right to left) as illustrated by the rotation arrow 48. Each of the first plurality of blades 40 and each of the second plurality of blades 46 have front and back faces that are substantially perpendicular to the surface supporting the cutting elements 46.

Variable pitch spiral blade 40*a* can be defined either mathematically by spline curves or by sequential segments defined according to FIG. 3 as follows. Specifically addressing the variable pitch spiral blade 40*a*, a segment 41 has an arc defined by a radius of curvature $R_1$, the segment 42 next in succession to the segment 41 has a radius of curvature $R_2$, and the segment 43 next in succession to the segment 42 has a radius of curvature $R_3$. Each of the segments 41, 42 and 43 of the variable pitch spiral blades 40*b*, 40*c* and 40*d* have a radius of curvature corresponding to the radius of curvature as illustrated and described with reference to the variable pitch spiral blade 40*a*.

It should be noted that the invention is not limited to variable pitch spiral blades having segments formed by radius of curvature. Each of the segments 41, 42 and 43 may be configured by spline curves calculated in accordance with mathematical equations based on a series of points in addition to the spline curves configured by a computer program with available software.

Figure 5:
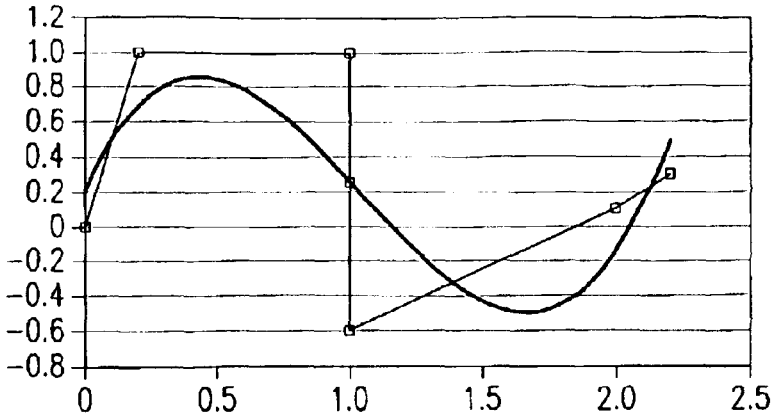
FIG. 5 represents an interpolation curve of seven points defining spline curve blade geometry, for a fourth order interpolation equation.
Figure 6:
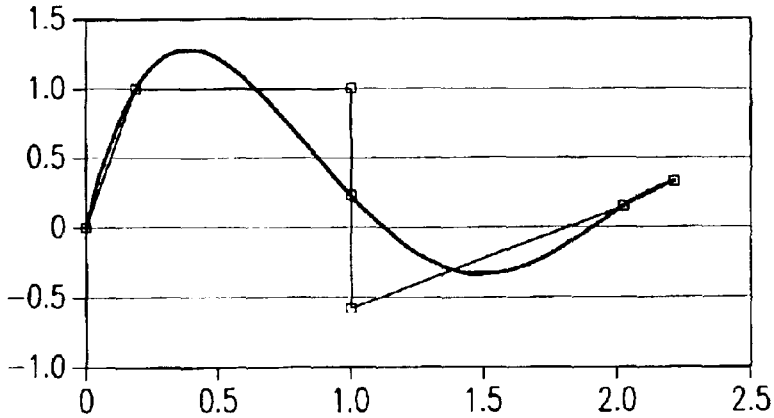
FIG. 6 represents an interpolation curve of seven points defining spline curve blade geometry, for a fifth order interpolation equation.
Figure 7:
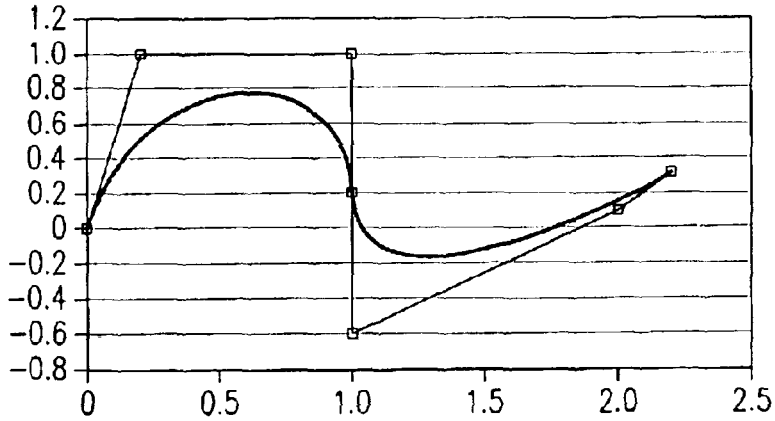
FIG. 7 represents a cubic Bezier interpolation curve of seven control points.

Referring to FIGS. 5, 6 and 7, there is illustrated representations of interpolation curves for defining the spline curves and the blade geometry. These figures illustrate one of several techniques for defining the spline curves by way of an interpolation equation of given points. FIGS. 5 and 6 illustrate interpolation curves of seven points where the interpolation equations are of the fourth and fifth order. Referring specifically to FIG. 7, a Bezier curve is one example of a non-linear interpolation equation which gives a weight for n+1 control points, $P_0$, $P_1$ through $P_n$. A Bezier curve can be expressed as follows:

$$P(t) = \sum_{i=0}^{n} \binom{n}{i} (1-t)^{n-1} t^i P_i,\ 0 \le t \le 1$$

FIG. 7 represents a cubic Bezier curve of seven control points. In addition to the Bezier interpolation, other algorithms for defining specific spline curves include B-spline curve, NURBS or Hermit interpolation.

Extending through the surface of the dome-shaped cutter head are a plurality of nozzles 50 opening into a fluid passage through the bit body to receive and direct drilling fluid pumped through the drill string. While the design of the nozzles 50 are conventional, the placement and orientation of the nozzles in the dome-shaped cutter head enable selective direction of fluid flow on the back surface (with reference to direction of rotation) of the blade in proximity thereto. This selective placement of the nozzles 50 and the variable pitch of the spiral blades 40 results in an improved flow of drilling fluid to clean the cutting elements and provide an aggressive flow of fluid to the gage area 44 and up through the annulus formed between the walls of the bore hole and the bit body.

It should be noted that in FIG. 3 the section of the dome-shaped cutter head between the variable pitched spiral blade 40*a* and the variable pitch spiral blade 40*b* is void of a fixed pitch spiral blade 46 and also is not illustrated as including nozzles 50. The fixed pitch spiral blade 46 and the nozzles 50 are not illustrated for ease in describing the variable pitch of each blade. It will be understood that the area between the variable pitch spiral blade 40*a* and the spiral blade 40*b* would include a fixed spiral blade 46 and selectively placed nozzles 50 as illustrated in each of the other three sections of the dome-shaped cutter head.

It should also be understood that the spiral pitch of each of the blades 40 may be either increasing (a positive pitch) or decreasing (negative pitch) from the center of the bit face to the gage area 44. As illustrated in FIG. 3 the variable pitch spiral blades 40 and the fixed pitch blades 46 are defined as having a positive pitch.

Figure 4:
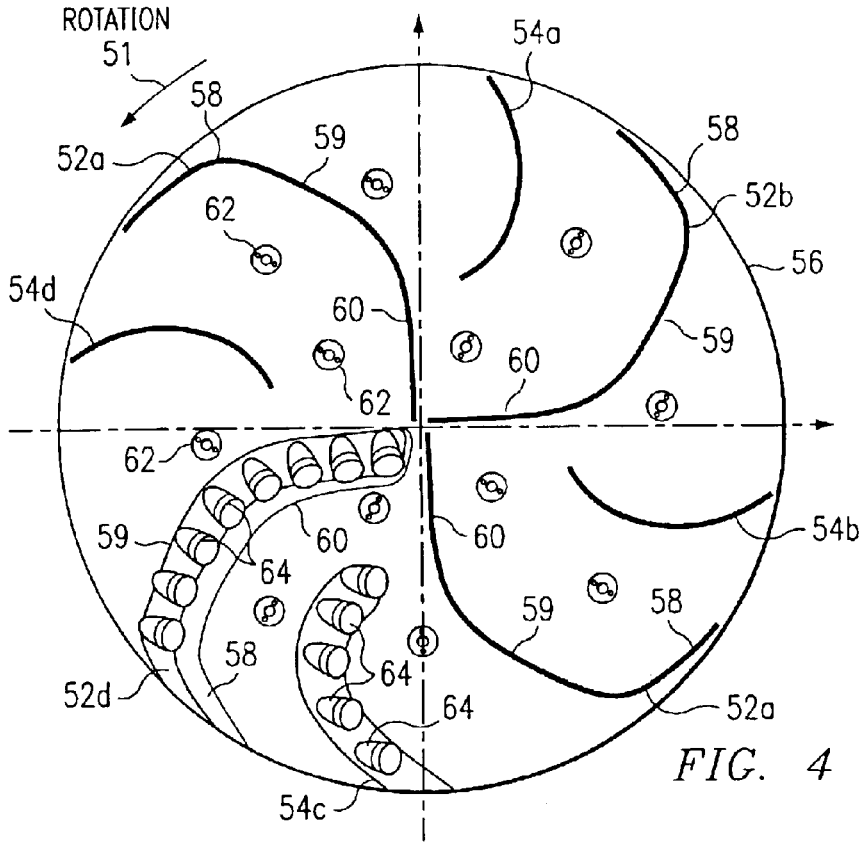
FIG. 4 is a schematic illustration of spiral-shaped blades with variable pitch extending from the cutter head of a bit body from the bit face to the gage area with a negative orientation for a drill bit rotating in the counterclockwise direction.

Referring to FIG. 4, there is illustrated a drill bit in accordance with the present invention having a substantially dome-shaped cutter head with variable pitch spiral blades and fixed pitch blades oriented in a direction identified as having a negative pitch with reference to the rotation direction of the drill bit, as illustrated by the rotation arrow 51. That is, the bit rotates counterclockwise as indicated by the rotation arrow 51.

Each of the first plurality of variable pitch spiral blades 52*a*, 52*b*, 52*c* and 52*d* have a configuration similar to the variable pitch spiral blades 40 of FIG. 3. However, as mentioned, the variable pitch spiral blades 40 of FIG. 3 have a positive pitch for a bit that rotates in the direction of the rotation arrow 48 while the variable pitch spiral blades 52 of FIG. 4 have a negative pitch for a drill bit that rotates in the direction of the rotation arrow 51.

Interspersed between the variable pitched spiral blades 52 are fixed pitch blades 54*a*, 54*b*, 54*c*, and 54*d*. The variable pitched spiral blades 52 extend from the center of the dome-shaped cutter head to the gage area 56 (schematically illustrated). The fixed pitch blades 54 do not extend to the center of the dome-shaped cutter head but continue to the gage area 56.

Similar to the configuration of the variable pitch spiral blades 40 of FIG. 3 the variable pitch spiral blades 52 of FIG. 4 each comprise three segments 58, 59 and 60 in succession. Each of the variable pitched spiral blades 52 may have an increasing or decreasing radius of curvature.

Although only three successive segments are illustrated in FIGS. 3 and 4, it will be understood by those skilled in the art in drill bits that more successive segments may be used in accordance with the present invention.

Mounted to the surface of each of the blades 52 and 54 are a plurality of cutting elements 62 again conventional in design and preferably PDC cutting elements.

Positioned between adjacent blades 52 and 54 are one or more nozzles 62 each having an inner end opening into the fluid passage through the bit body for directing drilling fluid to the blades 52 and 54 and the cutting elements 64.

As illustrated in FIGS. 3 and 4, the variable pitch spiral blades 40 and 52 have a positive or negative pitch variation depending upon the rotation of the drill bit. For the embodiments illustrated in FIGS. 3 and 4 each successive segment of the variable pitch spiral blade has a concave and/or convex configuration. However, the invention is not limited to successive segments having only a concave configuration but rather the variable pitch spiral blade may comprise a succession of concave and convex segments forming the spiral blade.

Figure 8A:
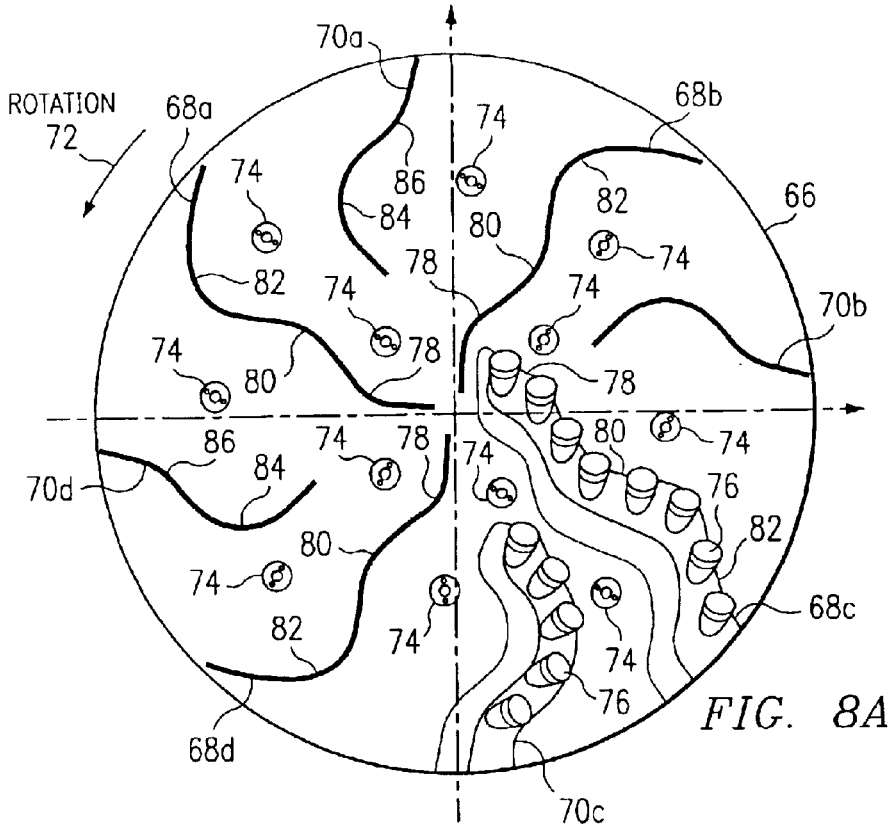
FIGS. 8A and 8B are pictorial illustrations of the cutter head of a drill bit having wave-shaped blades comprising a succession of concave segments and convex segments.
Figure 8B:
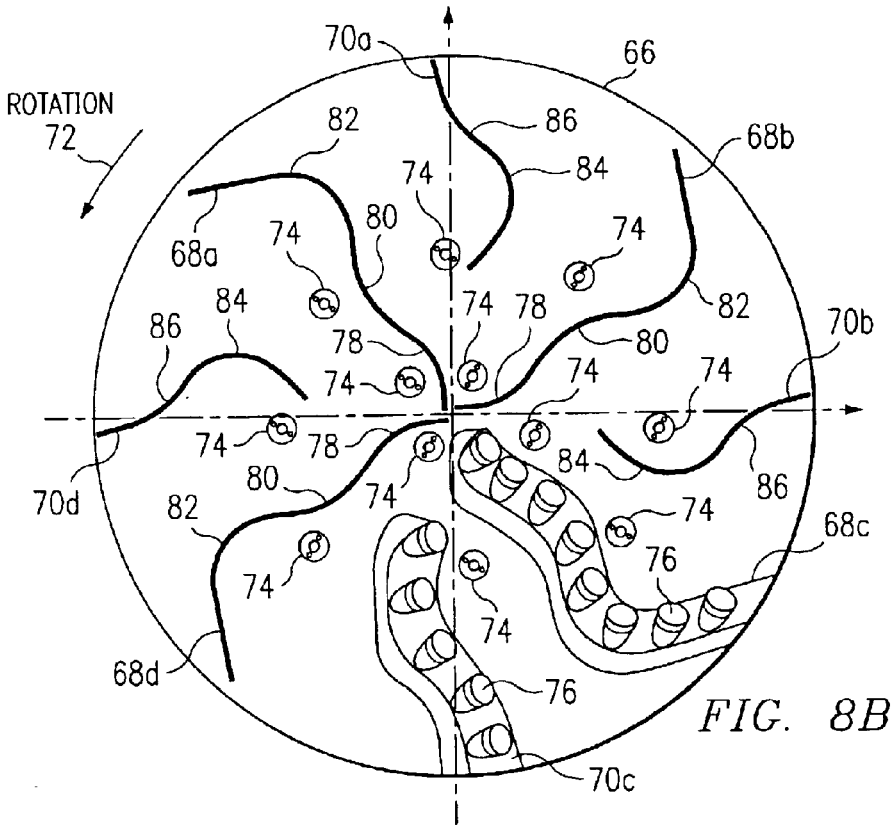

Referring to FIGS. 8A and 8B, there is shown an embodiment of the present invention wherein each of the blades formed on the dome-shaped cutter head has a variable pitch pattern of successive concave and convex segments (two or more segments in succession). The dome-shaped cutter head 66 is schematically illustrated along with a schematic illustration of each of the variable pitch spiral blades. The embodiment of the invention illustrated in FIGS. 8A and 8B comprises a first plurality of variable pitch spiral blades 68*a*, 68*b*, 68*c* and 68*d*, with each spiral blade comprising convex and concave segments successively interconnected. Between each of the adjacent variable pitch spiral blades 68 there is formed integral with and extending from the cutter head a second plurality of circumferentially spaced variable pitch spiral blades 70*a*, 70*b*, 70*c* and 70*d*, with each spiral blade comprising a convex and concave segment in succession.

Each of the first plurality of circumferentially spaced wave-shaped blades 68 comprises a variable pitch pattern curving from substantially the center of and around the cutter head 66 to the gage area. The wave-shaped variable pitch spiral blades 70 of the second plurality curve from a position displaced from the center of and around the cutter head 66 also to the gage area.

Referring to FIG. 8A, both the first plurality of wave-shaped variable pitch spiral blades 68 and the second plurality of wave-shaped variable pitch spiral blades 70 are curved in a "positive pitch" direction based on the direction of the rotation arrow 72.

Referring to FIG. 8B, both the first plurality of wave-shaped variable pitch spiral blades 68 and the second plurality of wave-shaped variable pitch spiral blades 70 are curved in a "negative pitch" direction based on the direction of the rotation arrow 72. Thus, FIGS. 8A and 8B illustrate similar first plurality of wave-shaped variable pitch spiral blades and similar second plurality of wave-shaped variable pitch spiral blades, the difference between the illustrations in FIGS. 8A and 8B is the "positive pitch" direction in FIG. 8A and the "negative pitch" direction of the spiral blades in FIG. 8B.

Strategically placed around and between the wave-shaped variable pitch spiral blades 68 and 70 are nozzles 74 for directing drilling fluid in the direction of the spiral blade to clean the blades and cutting elements embedded therein. As illustrated with reference to the spiral blades 68*c* and 70*c*, cutting elements 76 are embedded into the face of each of the blades in the direction of rotation of the drill bit. As with the embodiments illustrated in FIGS. 4, 8A and 8B, the front and back surfaces of the variable pitched spiral blades 68 and 70 are substantially perpendicular to the face of each blade. In addition, the front and back surfaces have a variable pitch following the variable pitch of the blade itself.

Each of the wave-shaped variable pitch spiral blades 68*a*, 68*b*, 68*c* and 68*d* comprise a succession of interconnected concave and/or convex segments, where concave and convex are defined in the direction of the rotation arrow 72 of the drill bit. As illustrated, each of the wave-shaped variable pitch spiral blades 68 comprises a convex or concave segment 78 followed in succession by a concave or convex segment 80 which in turn is followed in succession by a concave segment 82. The succession of concave and convex segments may each have the same pitch value or a different pitch value. With reference to the wave-shaped variable pitch spiral blades 70*a*, 70*b*, 70*c* and 70*d* each comprises a convex or concave segment 84 followed in succession by a concave or convex segment 86. Again, the pitch value of each segment may be the same or different. As illustrated, the pitch value for the segments 84 and 86 are not equal.

The wave-shaped variable pitch spiral blades 68 and 70 function along with the nozzles 74 to direct drilling fluid to remove cuttings from the face of the bore hole and flush the cuttings directly to the annulus between the gage area and the walls of the bore hole. The fluid flow is projected from each of the nozzles 74 on the back face (considering the direction of rotation) of the adjacent spiral blade thereby cleaning the cutting elements and avoiding an accumulation of sticky formation and cuttings induced by bit balling as previously described.

Figure 9A:
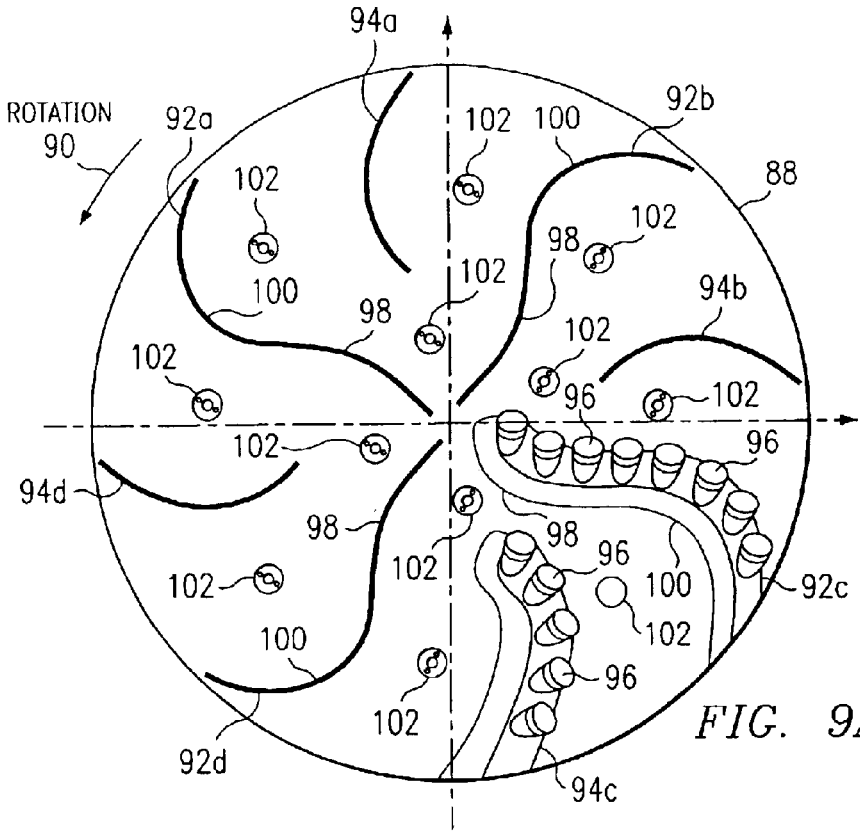
FIGS. 9A and 9B are schematic illustrations of the cutter head of a drill bit having a first plurality of variable pitch wave-shaped blades interspersed with a second plurality of fixed pitch blades.
Figure 9B:
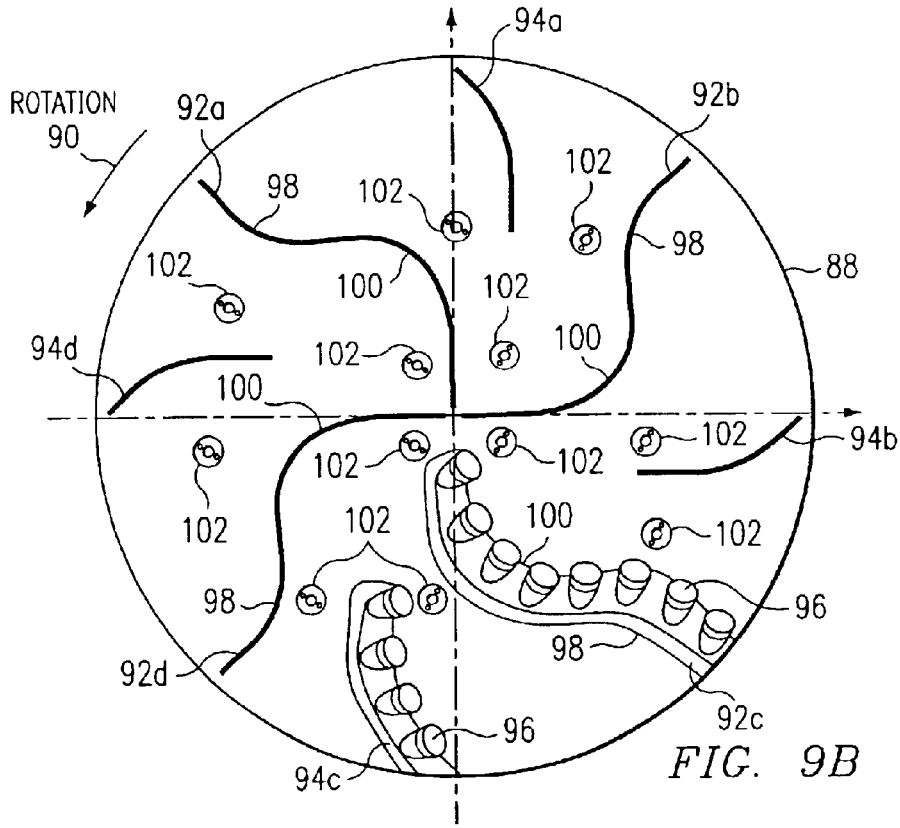

Referring to FIGS. 9A and 9B, there is illustrated an embodiment of the invention comprising a dome-shaped cutter head 88 of a drill bit rotating in a direction of rotation arrow 90 and comprising a plurality of wave-shaped variable pitch spiral blades 92*a*, 92*b*, 92*c* and 92*d*. Positioned between adjacent wave-shaped variable pitch spiral blades 92 are fixed pitch spiral blades 94*a*, 94*b*, 94*c* and 94*d*. Mounted to each of the spiral blades 92 and 94 are cutting elements 96 of a conventional design such as PDC cutting elements.

Referring to FIG. 9A, the wave-shaped variable pitch spiral blades 92 comprise curved successive segments beginning at substantially the center of and around the cutter head to the gage area, curving in a "positive direction" based on the direction of rotation arrow 90. The fixed pitch spiral blades 94 curve from a position displaced from the center of and around the cutter head 88 to the gage area, again in a "positive direction" based on the direction of rotation arrow 90.

Referring to FIG. 9B, the wave-shaped variable pitch spiral blades 92 comprise curved successive segments beginning at substantially the center of and around the cutter head to the gage area, curving in a "negative direction" based on the direction of rotation arrow 90. The fixed pitch spiral blades 94 curve from a position displaced from the center of and around the cutter head 88 to the gage area, again in a "negative direction" based on the direction of rotation arrow 90.

The wave-shaped variable pitch spiral blades 92 in the embodiment of FIGS. 9A and 9B comprise both convex and concave successive segments. Again, convex and concave is viewed from the direction of rotation of the drill bit. As illustrated, the wave-shaped variable pitch spiral blades 92 comprise a concave or convex segment 98 followed in succession by a convex or concave segment 100. As with the embodiments previously described the front and back surfaces of the spiral blades 92 and 94 are substantially perpendicular to the face of the blade and follow the pitch contour of each blade segment.

Fluid flow to remove cuttings from the face of the bore hole is provided through nozzles 102 spaced about the dome-shaped cutter head 88 to direct the fluid flow on the back face (considering the direction of rotation) of an adjacent spiral blade to flush the cutting elements 96 thereby cleaning sticky formation and cuttings from the elements and reducing bit balling. As illustrated in FIGS. 3 and 4, the spiral blades 92 and 94 have a positive or negative pitch, FIGS. 9A and 9B respectively, when the rotation of the drill bit has a counterclockwise rotation.

Figure 10:
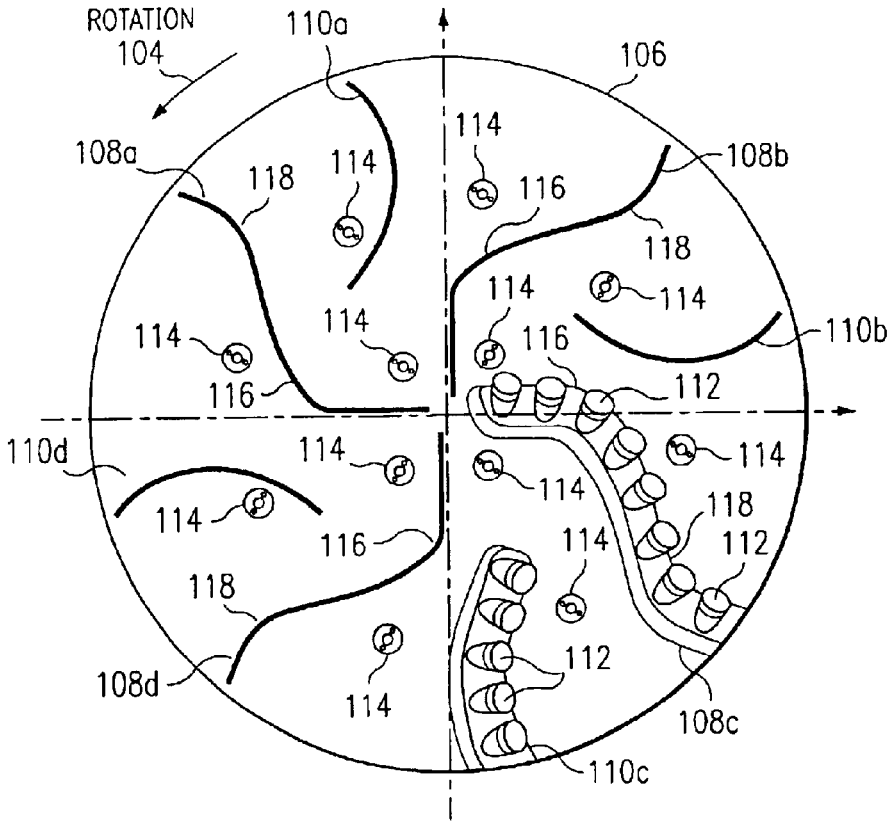
FIG. 10 is a schematic illustration of the cutter head of a drill bit comprising a first plurality of convex/concave sequential segments with an inversed general spiral shape interspersed with a second plurality of inversed fixed pitch blades.

Referring to FIG. 10, there is shown another embodiment of the present invention comprising a dome-shaped cutter head 106 with wave-shaped variable pitch spiral blades 108*a*, 108*b*, 108*c* and 108*d*. Located between the wave-shaped variable pitch spiral blades 108 is a fixed-pitch spiral blade 110*a*, 110*b*, 110*c* and 110*d*. Mounted to each face of the variable pitch spiral blades 108 and 110 are cutting element 112, typically PDC cutting elements. As described with reference to previously disclosed embodiments the front and back surfaces of each of the spiral blades 108 and 110 are substantially perpendicular to the face of the blade and substantially follow the pitch curvature of the blade. Positioned between adjacent spiral blades 108 and 110 are nozzles 114 for providing drilling fluid to flush the cuttings from the face of the dome-shaped cutter head 106 through the annulus between the bit body and walls of the bore hole.

As illustrated in FIG. 10, the spiral blades have a negative pitch for a drill bit rotating counterclockwise in the direction of rotation arrow 104.

As described with reference to the embodiment of FIGS. 9A and 9B each of the wave-shaped blades 108 comprises a convex segment 116 followed in succession by a concave segment 118 where the concave or convex orientation of the segments are determined by the rotation arrow 104.

Thus, as illustrated with reference to FIGS. 3, 4 and 8A through 10, the variable pitch spiral blade may comprise a succession of concave and/or convex segments (two or more) where the segments may have different pitch values. The concave or convex configuration of a segment is positioned to function as deflectors for the drilling fluid flow from the nearest nozzles, thus the position of a concave or convex segment and the nozzle position are selected to provide this deflector action.

Figure 11A:
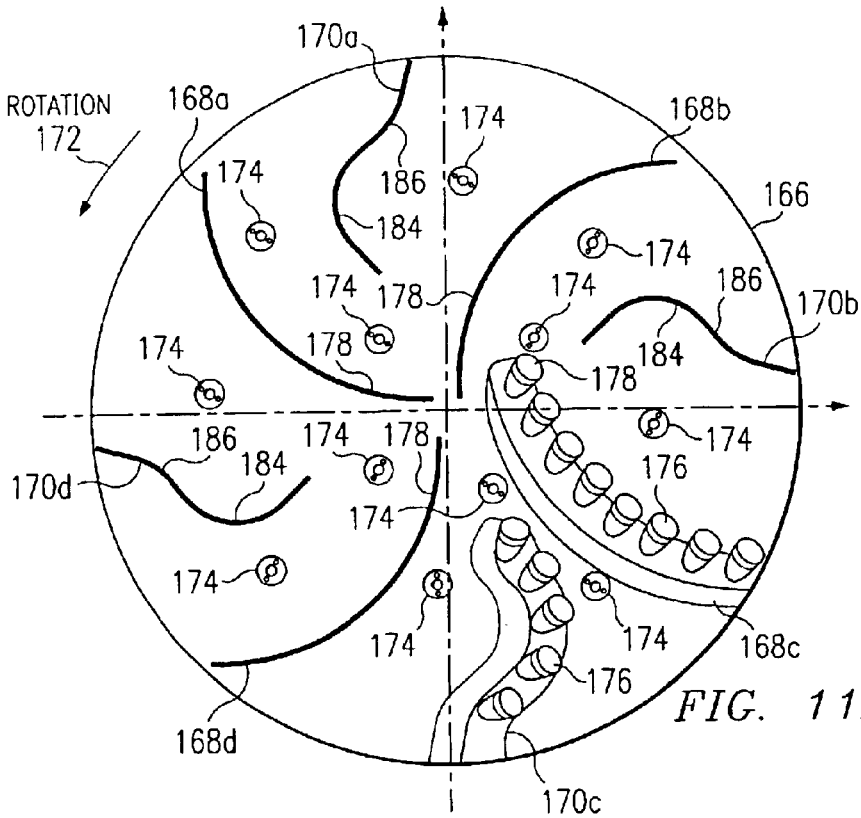
FIGS. 11A and 11B are schematic illustrations of the cutter head of a drill bit having a first plurality of fixed pitch wave-shaped blades interspersed with a second plurality of variable pitch blades.
Figure 11B:
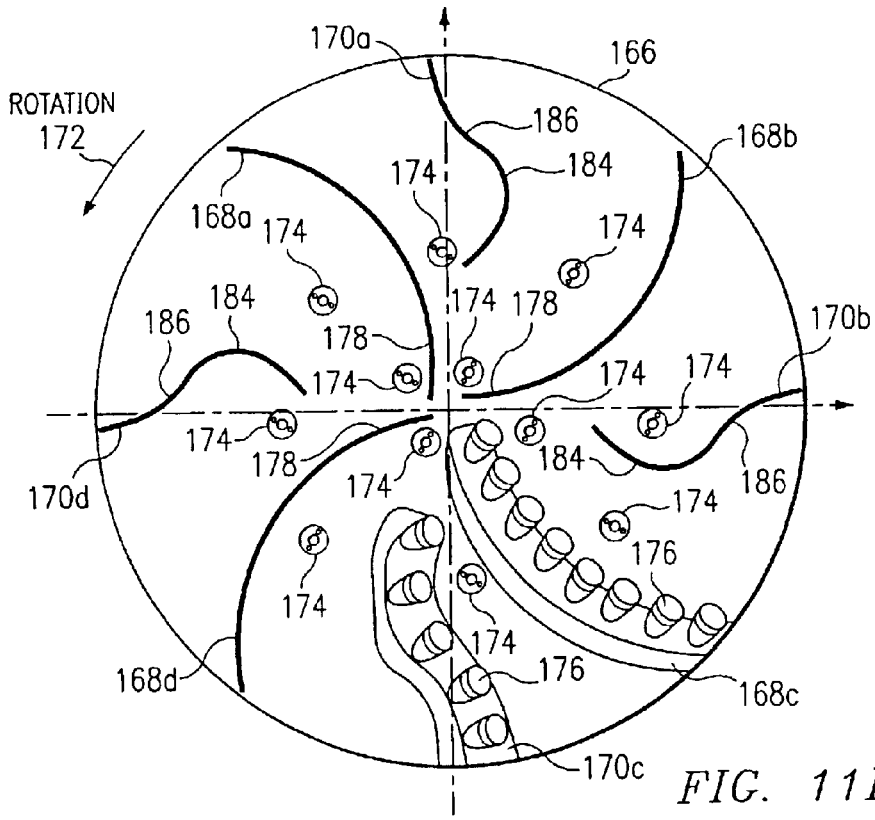

Referring to FIGS. 11A and 11B, there is shown an embodiment of the present invention wherein each of the primary blades formed on the dome-shaped cutter head has a fixed pitch and each of the secondary blades formed on the dome-shaped cutter head has a variable pitch pattern of successive concave and convex segments (two or more segments in succession). The dome-shaped cutter head 166 is schematically illustrated along with a schematic illustration of each of the primary fixed pitch blades and each of the variable pitch spiral blades. The embodiment of the invention illustrated in FIGS. 11A and 11B comprises a first plurality of fixed pitch spiral blades 168*a*, 168*b*, 168*c* and 168*d*, with each spiral blade comprising a fixed pitch segment. Between each of the adjacent fixed pitch spiral blades 168 there is formed integral with and extending from the cutter head a second plurality of circumferentially spaced variable pitch spiral blades 170*a*, 170*b*, 170*c* and 170*d*, with each spiral blade comprising a convex and concave segment in succession.

Each of the first plurality of circumferentially spaced blades 168 comprises a fixed pitch pattern curving from substantially the center of and around the cutter head 166 to the gage area. The wave-shaped variable pitch spiral blades 170 of the second plurality curve from a position displaced from the center of and around the cutter head 166 also to the gage area.

Referring to FIG. 11A, both the first plurality of fixed pitch spiral blades 168 and the second plurality of wave-shaped variable pitch spiral blades 170 are curved in a "positive pitch" direction based on the direction of the rotation arrow 172.

Referring to FIG. 11B, both the first plurality of fixed pitch spiral blades 168 and the second plurality of wave-shaped variable pitch spiral blades 170 are curved in a "negative pitch" direction based on the direction of the rotation arrow 172. Thus, FIGS. 11A and 11B illustrate similar first plurality of fixed pitch spiral blades and similar second plurality of wave-shaped variable pitch spiral blades, the difference between the illustrations in FIGS. 11A and 11B is the "positive pitch" direction in FIG. 11A and the "negative pitch" direction of the spiral blades in FIG. 11B.

Strategically placed around and between the fixed pitch spiral blades 168 and the wave-shaped variable pitch spiral blades 170 are nozzles 174 for directing drilling fluid in the direction of the spiral blade to clean the blades and cutting elements embedded therein. As illustrated with reference to the spiral blades 168*c* and 170*c*, cutting elements 176 are embedded into the face of each of the blades in the direction of rotation of the drill bit. As with the embodiments illustrated in FIGS. 4, 8A and 8B, the front and back surfaces of the fixed pitch blades 168 and the variable pitched spiral blades 170 are substantially perpendicular to the face of each blade. In addition, the front and back surfaces have a pitch following the pitch of the blade itself.

Each of the wave-shaped fixed pitch spiral blades 168*a*, 168*b*, 168*c* and 168*d* comprise a concave and/or convex segment, where concave and convex are defined in the direction of the rotation arrow 172 of the drill bit. As illustrated, each of the fixed pitch spiral blades 168 comprises a convex or concave segment 178. With reference to the wave-shaped variable pitch spiral blades 170*a*, 170*b*, 170*c* and 170*d* each comprises a convex or concave segment 184 followed in succession by a concave or convex segment 186. Again, the pitch value of each segment may be the same or different. As illustrated, the pitch value for the segments 184 and 186 are not equal.

The fixed pitch spiral blades 168 and the wave-shaped variable pitch spiral blades 170 function along with the nozzles 174 to direct drilling fluid to remove cuttings from the face of the bore hole and flush the cuttings directly to the annulus between the gage area and the walls of the bore hole. The fluid flow is projected from each of the nozzles 174 on the back face (considering the direction of rotation) of the adjacent spiral blade thereby cleaning the cutting elements and avoiding an accumulation of sticky formation and cuttings induced by bit balling as previously described.

Figure 12:
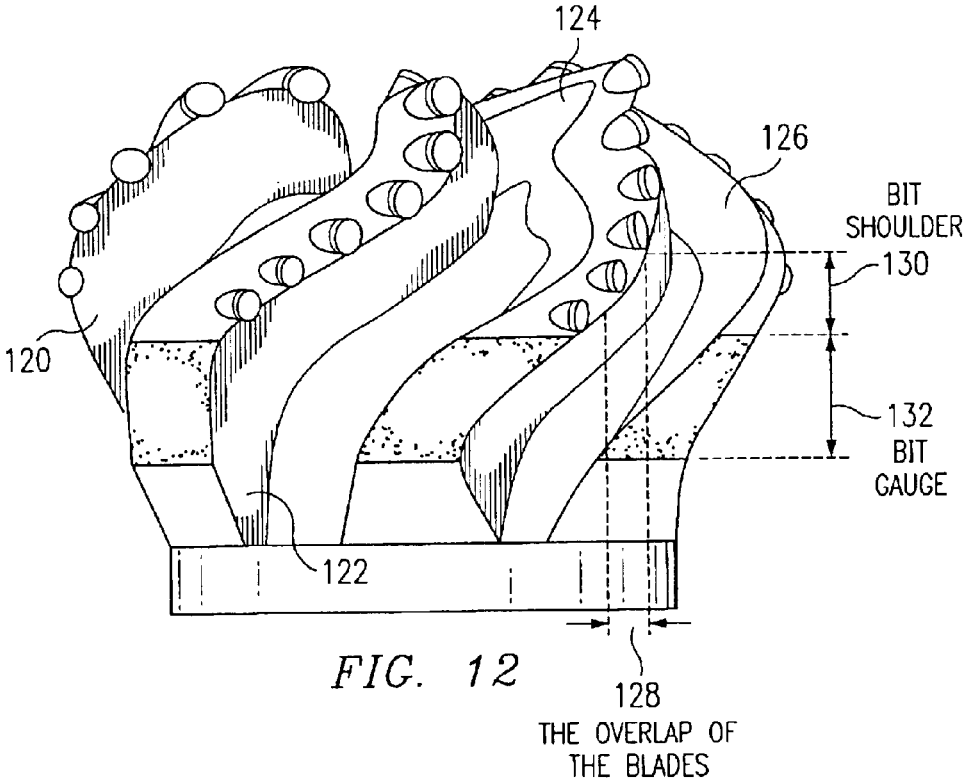
FIG. 12 is a pictorial side view of a dome-shaped cutter head showing overlap of adjacent blades in the bit shoulder and bit gage areas.

Referring to FIG. 12, there is illustrated a pictorial embodiment of the present invention showing the drilling fluid channels formed between adjacent spiral blades 120, 122, 124 and 126. Also illustrated in FIG. 12 is the overlap between adjacent blades where the blade overlap 128 is defined by the bit shoulder 130 and the bit gage area 132. The variable pitch spiral blades having a positive pitch for a bit that rotates in the direction of the rotation arrow 104 of FIG. 10. With reference to FIG. 12, the curvature of a blade is reversed as the blade approaches the gage area 132 in order to direct the fluid flow trajectory parallel to the bore hole axis. This is most clearly illustrated by the blades 124 and 126. The amount of curvature in a blade segment at the bit shoulder 130 varies with the length of the gage area 132.

Also as illustrated by blade 124, the curvature or pitch of the front surface of a blade (as determined by the direction of rotation) does not need to follow the pitch or curvature of the top surface of a blade. Thus, the front surface of the blade may vary in width depending upon the pitch or curvature of the front and rear surfaces. This enables the flow of drilling fluid to be directed to be most beneficial in clearing cuttings from the face of the bore hole and from around cutting elements thereby minimizing the balling effect. Further, the number of successive segments between the front face of a blade and the rear face of a blade do not necessarily have to coincide. This also enables customizing the direction of drilling fluid flow through the channels between adjacent blades.

As illustrated in FIGS. 3, 4 and 8A through 11B, the primary or central nozzles are positioned closest to the center of the dome-shaped cutter head and provide a drilling fluid flow to clean the cutting elements on the back face of a blade. Nozzles positioned in the dome-shaped cutter head removed from the center thereof are secondary nozzles and are positioned to provide a drilling fluid flow to clean convex segments of a blade.

Figure 13:
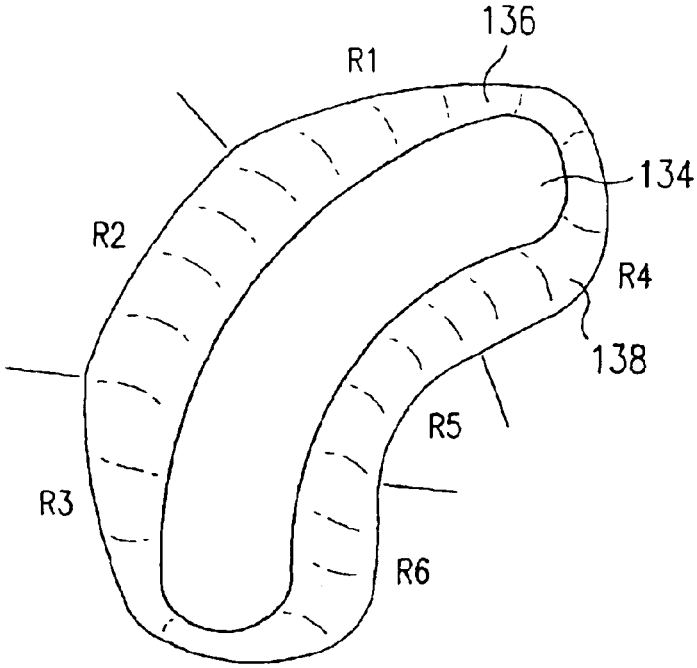
FIG. 13 is a pictorial illustration of a spiral fixed pitch blade having front and back faces of a wave-shaped variable spiral pitch with an equal number of successive segments on the front face and rear face.
Figure 14:
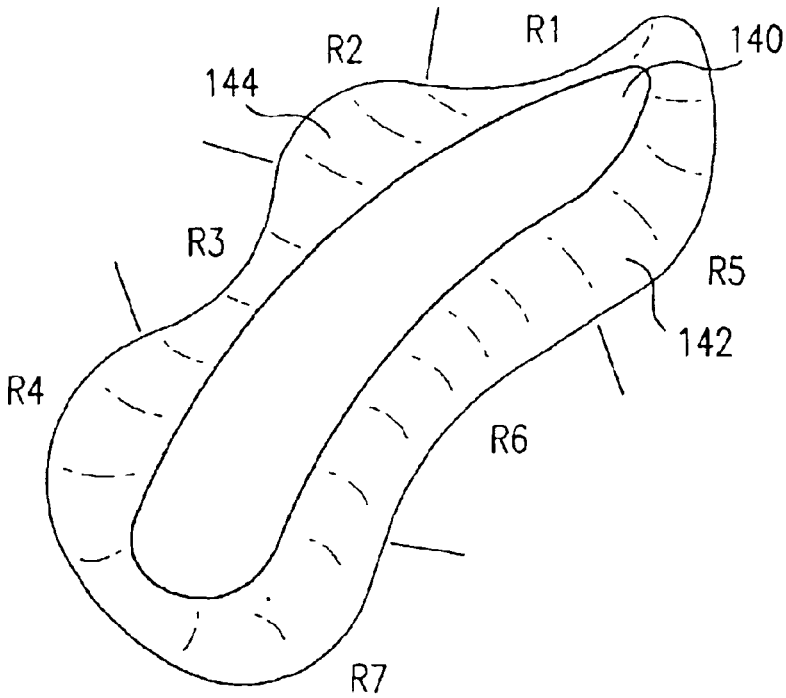
FIG. 14 is a pictorial illustration of a fixed pitch spiral blade having front and back faces of a wave-shaped variable spiral pitch wherein the number of successive segments on the front face does not equal the number of successive segments on the back face.

Referring to FIGS. 13 and 14, the spiral pitch of a blade may be fixed along the length thereof while the front and back faces have variable spiral pitch defining a wave shape. With reference to FIG. 13, the blade 134 has a fixed spiral pitch with the front and back faces 136 and 138 each having a variable pitch. For example, the front face 136 has three convex segments in succession with radiuses $R_1$, $R_2$ and $R_3$. The back face has a convex segment having a pitch radius of $R_4$ followed in succession by a concave segment having a pitch radius $R_5$ which in turn is followed in succession by a convex segment having a pitch radius of $R_6$.

Referring to FIG. 14, there is shown a fixed pitch spiral blade 140 wherein the number of successive segments ($R_1$, $R_2$, $R_3$, $R_4$) on the front face 142 does not equal the number of successive segments ($R_5$, $R_6$, $R_7$) on the back face 144. This is also illustrated in FIG. 11 for the blade 124 having a wave-shaped variable pitch. Thus, each of the blades 134 of FIG. 13 and the blade 140 of FIG. 14 may be utilized in each of the embodiments of FIGS. 3, 4 and 8A through 11B in place of the spiral blades illustrated.

While the invention has been described with reference to the illustrated embodiments, it is intended to cover such alternatives, modifications and equivalents as may be included in the spirit and scope of the invention as defined in the following claims.

What is claimed is:

1. A drag-type drill bit for bore hole drilling in earth formations, comprising:

a bit body having a threaded pin on one end for coupling to a drill string;

a substantially dome-shaped cutter head formed integral with the bit body opposite from the threaded pin;

a plurality of circumferentially spaced first blades formed integral with and extending from the cutter head, the first blades extending from substantially the center of and around the cutter head to the gage area;

a plurality of second blades being positioned alternatively between the first blades, the second blades extending from respective positions offset from the center of the cutter head and extending toward the gauge area;

a plurality of generally cylindrical cutting elements embedded in each of the first blades;

a plurality of nozzles positioned around the cutter head to direct drilling fluid passing through the bit body against the wave-shaped blades to the annulus surrounding the bit body in the bore hole; and wherein the first blades comprise a variable pitch bi-directional pattern having a succession of concave and convex segments.

2. The drag-type drill bit as in claim 1 wherein at least one first blade includes a leading surface that overlaps a trailing surface of an adjacent one of the plurality of second blades, in the direction of rotation of the bit body.

3. A drag-type drill bit for bore hole drilling in earth formations, comprising:

a bit body having a threaded pin on one end for coupling to a drill string;

a substantially dome-shaped cutter head formed integral with the bit body opposite from the threaded pin;

a plurality of circumferentially spaced first blades formed integral with and extending from the cutter head, the first blades extending from substantially the center of and around the cutter head to the gage area;

a plurality of second blades being positioned alternatively between the first blades, the second blades extending from respective positions offset from the center of the cutter head and extending toward the gauge area;

a plurality of generally cylindrical cutting elements embedded in each of the first blades;

a plurality of nozzles positioned around the cutter head to direct drilling fluid passing through the bit body against the wave-shaped blades to the annulus surrounding the bit body in the bore hole; and wherein the first blades comprise wave shaped blades having a variable pitch pattern having a succession of segments, the variable pitch pattern curving from substantially the center of and around the cutter head to the gage area in the direction of rotation of the bit body, or in the direction opposite to the direction of rotation of the bit body.

4. The drag-type drill bit as in claim 3 wherein the last segment of each of the plurality of first blades positioned from the center of the cutter head comprises a substantially straight, slightly curved segment substantially parallel to the longitudinal axis of the bit body.

5. The drag-type drill bit as in claim 3 wherein the variable pitch of the wave-shaped blades increases along the length of the pattern.

6. The drag-type drill bit as in claim 3 wherein the variable pitch of the wave-shaped blades decreases along the length of the pattern.

7. The drag-type drill bit as in claim 3 wherein the variable pitch of the wave-shaped blades increases for selected segments and decreases for other selected curved segments.

8. The drag-type drill bit as in claim 3 wherein the variable pitch of the wave-shaped blades increases for selected segments and decreases as the blade approaches the gage area.

9. A drag-type drill bit for bore hole drilling in earth formations, comprising:

a bit body having a threaded pin end for coupling to a drill string;

a substantially dome-shaped cutter head formed integral with the bit body opposite from the threaded pin;

a first plurality of circumferentially spaced wave-shaped blades formed integral with and extending from the cutter head, the first plurality of wave-shaped blades comprising a variable pitch pattern having a succession of segments, the variable pitch pattern curving from substantially the center of and around the cutter head to the gage area thereof in the direction of rotation of the bit body or in the direction opposite to the rotation of the bit body;

a second plurality of circumferentially spaced blades formed integral with and extending from the cutter head between adjacent wave-shaped blades of the first plurality, the blades of the second plurality comprising a fixed pitch pattern curving from a position displaced from the center of and around the cutter head to the gage area thereof in the direction of rotation of the bit body or in the direction opposite to the rotation of the bit body;

a plurality generally cylindrical cutting elements embedded in each of the first plurality of wave-shaped blades and the second plurality of blades; and a plurality of nozzles positioned around the cutter head to direct drilling fluid passing through the bit body against the first plurality of wave-shaped blades and the second plurality of blades to the annulus surrounding the bit body and the bore hole.

10. The drag-type drill bit as in claim 9 wherein the first plurality of wave-shaped blades comprises a variable pitch bi-directional pattern having a succession of concave and convex curved segments.

11. The drag-type drill bit as in claim 9 wherein each of the first plurality of wave-shaped blades positioned from the center of the cutter head comprises a substantially straight segment substantially parallel to the longitudinal axis of the bit body.

12. The drag-type drill bit as in claim 9 wherein the leading surface of a blade overlaps the trailing surface of the adjacent blade in the direction of rotation of the bit body.

13. The drag-type drill bit as in claim 9 wherein a part of the plurality of nozzles are individually positioned in proximity to the first segment of the first plurality of wave-shaped blades to direct drilling fluid from the associated nozzle against this part of the blade.

14. The drag-type drill bit as in claim 9 wherein the variable pitch of the wave-shaped blades increases for selected curved segments and reverses as the blade approaches the gage area.

15. A drag-type drill bit for bore hole drilling in earth formations, comprising:

a bit body having a threaded pin at one end thereof for coupling to a drill string;

a substantially dome-shaped cutter head formed integral with the bit body opposite from the threaded pin;

a plurality of circumferentially spaced blades formed integral with and extending from the cutter head, the blades comprising a fixed pitch top surface and a variable pitch leading surface having a succession of curved segments, the variable pitch leading surface curving from substantially the center of and around the cutter head to the side thereof in the direction of rotation of the bit body or in the direction opposite to the direction of the bit body;

a plurality of generally cylindrical cutting elements embedded in each of the blades;

a plurality of nozzles positioned around the cutter head to direct drilling fluid passing through the bit body against the circumferentially spaced blades to the annulus surrounding the bit body in the bore hole.

16. The drag-type drill bit as set forth in claim 15 wherein each circumferentially spaced blade comprises a variable pitch trailing surface having a succession of curved segments, the variable pitch pattern curving from substantially the center and around the cutter head to the side thereof.

17. The drag-type drill bit as in claim 16 wherein the variable pitch leading surface and the variable pitch trailing surface of each of the circumferentially spaced blades comprises a bi-directional curved pattern.

18. The drag-type drill bit as in claim 17 wherein the variable pitch leading surface and the variable pitch trailing surface of each of the circumferentially spaced blades comprises a succession of concave segments having selected radius values.

19. The drag-type drill bit as in claim 17 wherein the variable pitch leading surface and the variable pitch trailing surface of each of the circumferentially spaced blades comprises a succession of convex segments having selected radius values.

20. The drag-type drill bit as in claim 17 wherein the variable pitch leading surface and the variable pitch trailing surface of each of the circumferentially spaced blades comprises a succession of concave or convex segments having selected radius values.

21. The drag-type drill bit as in claim 15 wherein each of the plurality of circumferentially spaced blades comprises a substantially straight, slightly curved segment at the gage end of the blade, the substantially straight, slightly curved segment substantially parallel to the longitudinal axis of the bit body.

22. The drag-type drill bit as in claim 15 wherein the variable pitch leading surface of each circumferentially spaced blade comprises a succession of concave segments having selected radius values.

23. The drag-type drill bit as in claim 15 wherein the variable pitch leading surface of each circumferentially spaced blade comprises a succession of convex segments having selected radius values.

24. The drag-type drill bit as in claim 15 wherein the variable pitch leading surface of each circumferentially spaced blade comprises a succession of concave or convex segments having selected radius values.

25. The drag-type drill bit as in claim 15 wherein the variable pitch of the leading and trailing surfaces increases for selected curved segments and reverses as the blade approaches the gage area.

26. A drag-type drill bit for bore hole drilling in earth formation, comprising:

a bit body having a threaded pin on one end thereof for coupling to a drill string;

a substantially dome-shaped cutter head formed integral with the bit body opposite from the threaded pin;

a first plurality of circumferentially spaced wave-shaped blades formed integral with and extending from the cutter head, the first plurality of wave-shaped blades comprising a variable pitch pattern having a succession of curved segments, the variable pitch pattern curving from substantially the center of and around the cutter head to the side thereof in the direction of rotation of the bit body or in the direction opposite to rotation of the bit body;

a second plurality of circumferentially spaced wave-shaped blades formed integral with and extending from the cutter head, the second plurality of wave-shaped blades comprising a variable pitch pattern having a succession of curved segments, the variable pitch pattern of the second plurality of wave-shaped blades curving from a starting position displaced from the center of the cutter head to the side thereof in the direction of rotation of the bit body or in the direction opposite to rotation of the bit body, the second plurality of circumferentially spaced wave-shaped blades positioned between adjacent ones of the first plurality of circumferentially spaced wave-shaped blades;

a plurality of generally cylindrical cutting elements embedded in each of the first and second plurality of wave-shaped blades; and a plurality of nozzles positioned around the cutter head to direct drilling fluid passing through the bit body against the wave-shaped blades to the annulus surrounding the bit body in the bore hole.

27. The drag-type drill bit as in claim 26 wherein the wave-shaped blades comprise a variable pitch bi-directional pattern having a succession of concave and convex segments.

28. The drag-type drill bit as in claim 26 wherein the leading surface of a blade overlaps. the trailing surface of the adjacent blade in the direction of rotation of the bit body.

29. The drag-type drill bit as in claim 26 wherein the variable pitch of the wave-shaped blades increases along the length of the pattern.

30. The drag-type drill bit as in claim 26 wherein the variable pitch of the wave-shaped blades decreases along the length of the pattern.

31. The drag-type drill bit as in claim 26 wherein the variable pitch of the wave-shaped blades increases for selected segments and decreases for other selected curved segments.

32. The drag-type drill bit as in claim 26 wherein the variable pitch of the wave-shaped blades increases for selected segments and decreases as the blade approaches the gage area.

33. The drag-type drill bit as in claim 26 wherein the first plurality of wave-shaped blades comprises a variable pitch bi-directional pattern having a succession of concave and convex curved segments.

34. The drag-type drill bit as in claim 26 wherein a part of the plurality of nozzles are individually positioned in proximity to the first segment of the first plurality of wave-shaped blades to direct drilling fluid from the associated nozzle against this part of the blade.

35. The drag-type drill bit as in claim 26 wherein the second plurality of wave-shaped blades comprises a variable pitch bi-directional pattern having a succession of concave and convex curved segments.

36. The drag-type drill bit as in claim 26 wherein a part of the plurality of nozzles are individually positioned in proximity to the first segment of the second plurality of wave-shaped blades to direct drilling fluid from the associated nozzle against this part of the blade.

37. A drag-type drill bit for bore hole drilling in earth formation, comprising:

a bit body having a threaded pin on one end thereof for coupling to a drill string;

a substantially dome-shaped cutter head formed integral with the bit body opposite from the threaded pin;

a plurality of circumferentially spaced primary fixed pitch spiral blades formed integral with and extending from the cutter head, the plurality of primary blades comprising a fixed pitch pattern having a curved segment, the fixed pitch pattern curving from substantially the center of and around the cutter head to the side thereof in the direction of rotation of the bit body or in the direction opposite to rotation of the bit body;

a plurality of circumferentially spaced secondary wave-shaped blades formed integral with and extending from the cutter head, the plurality of secondary wave-shaped blades comprising a variable pitch pattern having a succession of curved segments, the variable pitch pattern of the second plurality of wave-shaped blades curving from a starting position displaced from the center of the cutter head to the side thereof in the direction of rotation of the bit body or in the direction opposite to rotation of the bit body, the plurality of circumferentially spaced secondary wave-shaped blades positioned between adjacent ones of the plurality of circumferentially spaced primary blades;

a plurality of generally cylindrical cutting elements embedded in each of the primary and secondary wave-shaped blades; and a plurality of nozzles positioned around the cutter head to direct drilling fluid passing through the bit body against the primary and secondary blades to the annulus surrounding the bit body in the bore hole.

38. The drag-type drill bit as in claim 37 wherein the plurality of secondary blades comprise a variable pitch bi-directional pattern having a succession of concave and convex segments.

39. The drag-type drill bit as in claim 37 wherein the leading surface of a blade overlaps the trailing surface of the adjacent blade in the direction of rotation of the bit body.

40. The drag-type drill bit as in claim 37 wherein the variable pitch of the secondary wave-shaped blades increases along the length of the pattern.

41. The drag-type drill bit as in claim 37 wherein the variable pitch of the secondary wave-shaped blades decreases along the length of the pattern.

42. The drag-type drill bit as in claim 37 wherein the variable pitch of the secondary wave-shaped blades increases for selected segments and decreases for other selected curved segments.

43. The drag-type drill bit as in claim 37 wherein the variable pitch of the secondary wave-shaped blades increases for selected segments and decreases as the blade approaches the gage area.

44. The drag-type drill bit as in claim 37 wherein a part of the plurality of nozzles are individually positioned in proximity to the segment of the plurality of primary fixed pitch blades to direct drilling fluid from the associated nozzle against this part of the blade.

45. The drag-type drill bit as in claim 37 wherein a part of the plurality of nozzles are individually positioned in proximity to the first segment of the plurality of secondary wave-shaped blades to direct drilling fluid from the associated nozzle against this part of the blade.

* * * * *